US007159715B2

(12) United States Patent
Cornelius et al.

(10) Patent No.: US 7,159,715 B2
(45) Date of Patent: Jan. 9, 2007

(54) CONTAINER WITH INTEGRATED PALLET FOR SHIPPING TELEVISION SCREENS

(75) Inventors: Adam C. Cornelius, Hayden, AL (US); Bernhard F. Reumuller, Groose Ile, MI (US); Edward C. Vogel, Romulus, MI (US)

(73) Assignee: International Paper Company, Memphis, TN (US)

( * ) Notice: Subject to any disclaimer, the term of this patent is extended or adjusted under 35 U.S.C. 154(b) by 159 days.

(21) Appl. No.: 10/845,766

(22) Filed: May 14, 2004

(65) Prior Publication Data

US 2005/0029141 A1 Feb. 10, 2005

Related U.S. Application Data

(60) Provisional application No. 60/471,136, filed on May 15, 2003.

(51) Int. Cl.
*B65D 85/42* (2006.01)
*B65D 19/00* (2006.01)

(52) U.S. Cl. ..... 206/421; 206/386

(58) Field of Classification Search ..... 206/386, 206/595–600, 448, 418–421; 280/845; 108/55.3

See application file for complete search history.

(56) References Cited

U.S. PATENT DOCUMENTS 2,743,010 A * 4/1956 Koester ..... 206/597
3,414,124 A * 12/1968 Lidgard ..... 206/448
3,519,244 A * 7/1970 Lidgard ..... 206/448
3,596,830 A * 8/1971 McFarland et al. ..... 206/420
3,717,245 A * 2/1973 Brander et al. ..... 206/386
3,924,871 A * 12/1975 Mesenbring ..... 280/845
3,930,579 A * 1/1976 Kurtz ..... 206/419
4,027,794 A 6/1977 Olson
4,030,600 A 6/1977 Heaps
4,044,981 A 8/1977 Richter
4,085,846 A 4/1978 Williams
4,296,860 A 10/1981 Hsu et al.
4,311,239 A * 1/1982 Schlicker ..... 206/597
4,383,609 A 5/1983 Lochmiller
4,712,687 A 12/1987 Silcott et al.
4,760,922 A 8/1988 Northgrave
4,763,787 A * 8/1988 Koenig ..... 206/420
4,838,418 A 6/1989 Teixeira
4,927,026 A 5/1990 Gossler et al.

(Continued)

FOREIGN PATENT DOCUMENTS

EP 0059667 A2 9/1982

(Continued)

*Primary Examiner*—Bryon P. Gehman
(74) *Attorney, Agent, or Firm*—Thomas W. Barnes, III; Daniel C. Stelter; Dennis H. Lambert

(57) ABSTRACT

A container for shipping screens for large screen television sets has a screen support platform with a top surface for supporting a plurality of the screens stacked thereon. A pallet is integrated with the screen support platform, and a tubular side wall having an open top end and an open bottom end is adapted to rest at its bottom end on the pallet, with the side wall disposed around a stack of screens supported on the platform. A cover is provided for placement over the open top end of the tubular side wall. The screen support platform, pallet, side wall, and cover are all constructed of corrugated cardboard. In a preferred embodiment, a tray forms the top deck of the pallet, and the support platform is received in the tray.

36 Claims, 11 Drawing Sheets

U.S. PATENT DOCUMENTS

| | | | |
|---|---|---|---|
| 5,110,037 | A | 5/1992 | Pieritz, Sr. |
| 5,215,248 | A | 6/1993 | Moser |
| 5,350,066 | A | 9/1994 | Mendoza et al. |
| 5,441,154 | A | 8/1995 | Youell, III |
| 5,622,306 | A | 4/1997 | Grigsby, Sr. |
| 6,050,410 | A | 4/2000 | Quirion |
| 6,079,560 | A | 6/2000 | Champion |
| 6,098,803 | A | 8/2000 | Tanaka et al. |
| 6,270,007 | B1 | 8/2001 | Jensen, Jr. |

FOREIGN PATENT DOCUMENTS

| | | | |
|---|---|---|---|
| EP | 0124425 | A1 | 11/1984 |
| EP | 0283006 | A2 | 9/1988 |
| EP | 0410915 | A2 | 1/1991 |
| FR | 2798905 | | 3/2001 |
| WO | WO9402366 | A1 | 2/1994 |
| WO | WO9617784 | A2 | 8/1997 |

* cited by examiner

CONTAINER WITH INTEGRATED PALLET FOR SHIPPING TELEVISION SCREENS

This application claims the benefit of U.S. Provisional Patent Application Ser. No. 60/471,136, filed May 15, 2003.

TECHNICAL FIELD

This invention relates to packaging, and more particularly to a container and integrated pallet made from corrugated cardboard for shipping a plurality of objects arranged in a stack in the container. The container of the invention is especially constructed and adapted for shipping plastic television screens for big screen television sets.

BACKGROUND ART

Plastic screens for large screen television sets typically range in size from about 43 inches up to about 61 inches, and have a slightly curved configuration. These screens are supplied to the manufacturers of big screen television sets for application of the screens to the sets. Fifty to seventy-five screens are typically stacked and shipped in a package that includes a screen support base and an integrated pallet, both made of wood, and a side wall and cover made from corrugated cardboard. The screens are about ⅛ inch thick and are stacked with foam sheets or inserts about 1/16 inch thick interposed between the screens. A typical conventional package has a height of about thirty inches and weighs approximately 750 pounds.

Conventional packaging for plastic screens for large screen television sets is relatively heavy and expensive, and the parts made from wood are not readily recyclable.

Accordingly, there is need for a less expensive, lighter weight, fully recyclable package for shipping plastic screens for large screen television sets.

DISCLOSURE OF THE INVENTION

The present invention comprises a container and integrated pallet made from corrugated cardboard for shipping plastic screens for large screen television sets. The container of the invention is less expensive and lighter in weight than conventional containers, and is fully recyclable. It includes a pallet on which is mounted a curved support base for the curved screens, a container side wall extending upwardly from the pallet, and a cover, all made from corrugated cardboard.

The pallet includes a bottom deck on top of which are fixed a plurality of pallet blocks or spacers. The bottom deck may have openings through it for accommodating the wheels of a pallet jack. A tray having a bottom pad and relatively narrow upstanding side walls is fixed on top of the pallet blocks and forms a pallet top deck. The screen support base is fixed inside the tray and comprises a perimeter frame and a plurality of transversely extending supports having a top surface curved to conform to the curvature of the screens to be supported thereon. The container side wall is an open-ended tubular structure that rests at its lower end in the tray.

In use, a plurality (typically 50–75) of screens are stacked on the screen support base, with foam inserts interspersed between the screens, and the open-ended tubular container side wall is then placed down over the stack of screens, with its lower end resting in the tray. The cover is then placed on the open upper end of the side wall, and one or more straps may be placed around the package to hold it assembled during handling.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DESCRIPTION OF THE PREFERRED EMBODIMENTS

Figure 1:
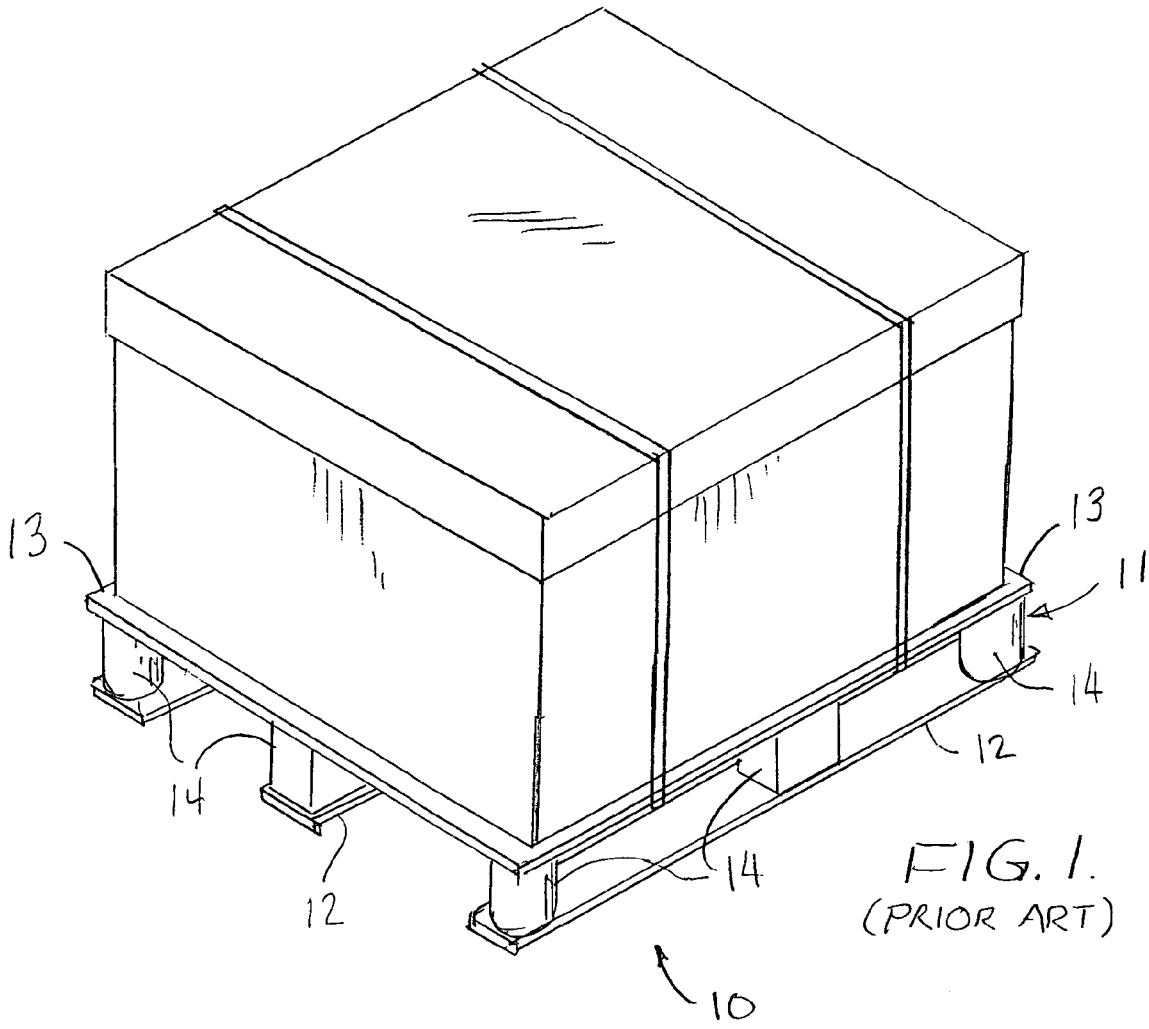
FIG. 1. (PRIOR ART)
FIG. 1 is a top perspective view of a conventional package for shipping screens for large screen television sets.
Figure 2:
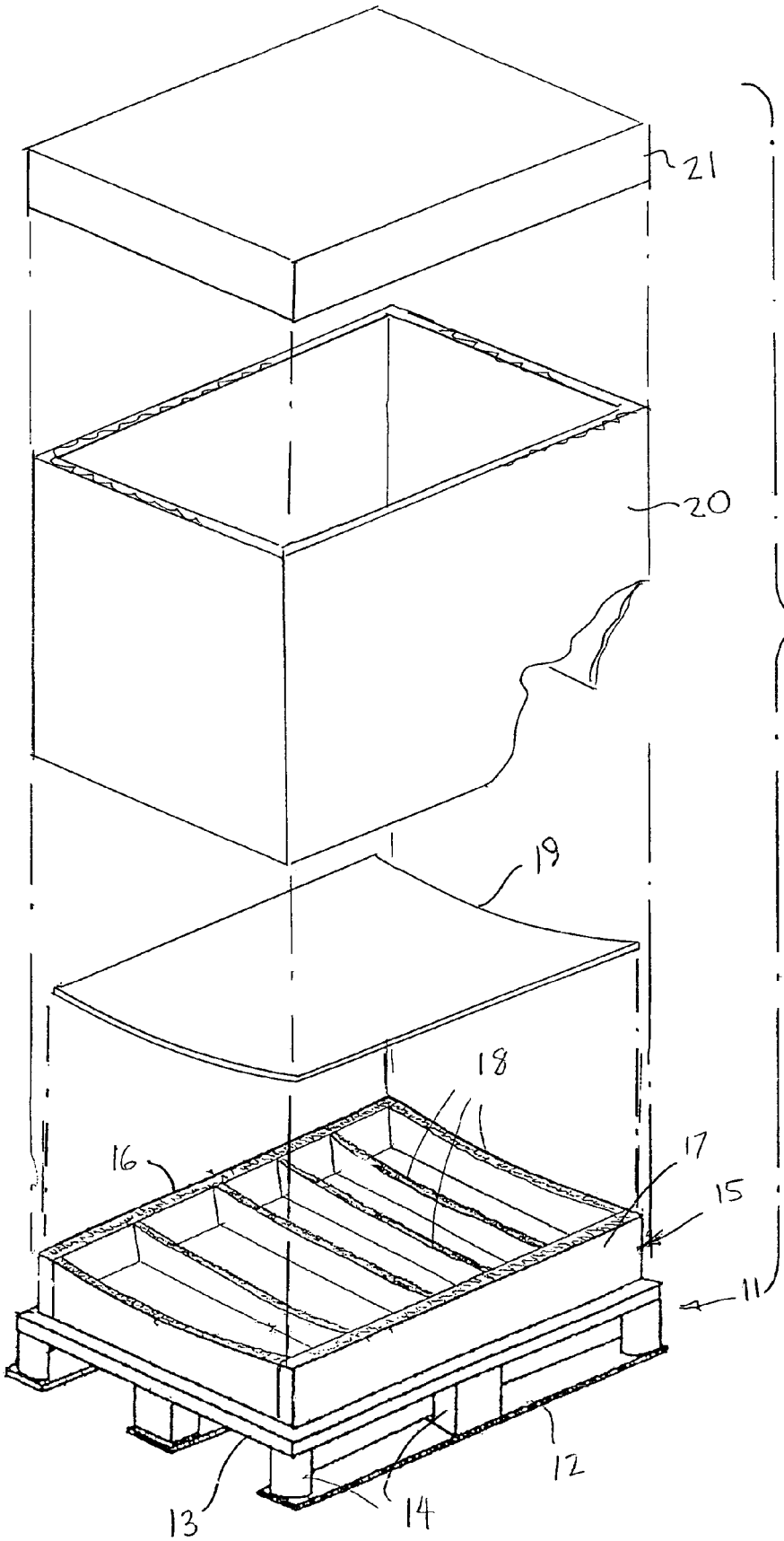
FIG. 2. (PRIOR ART)
FIG. 2 is a top exploded perspective view, with portions broken away for purpose of illustration, of the prior art package of FIG. 1.

A prior art shipping container for plastic screens for large screen television sets is indicated generally at 10 in FIGS. 1 and 2. As noted earlier, these screens typically range in size from about 43 inches up to about 61 inches, and have a slightly curved configuration. They are about ⅛ inch thick and are stacked with foam sheets or inserts about 1/16 inch thick interposed between the screens (see FIG. 4). Fifty to seventy-five screens are typically stacked and shipped in a container. A completed package has a height of about thirty inches and weighs approximately 750 pounds.

The prior art container 10 comprises a pallet 11 having a bottom deck 12, a top deck 13, and a plurality of pallet blocks or spacers 14 extending between the top and bottom decks to define spaces for receiving the tines of a fork lift (not shown). All of these components are made of wood, and a typical pallet constructed in this manner can weigh upwards of fifty pounds. A screen support platform 15 is mounted on top of the pallet, and comprises a frame having opposite side pieces 16 and 17 and a plurality of transverse beams 18 extending in equally spaced apart relationship between the opposite side pieces. In order to accommodate the curvature of the screens being packaged, the top surface of the beams is curved to conform to the curvature of the screens. A thin sheet 19 of material such as wood or plastic is fixed on top of the frame and is curved to conform to the curvature of the frame and to the screens to be supported thereon. The components of the support platform are also made of wood and thus have considerable weight. After a desired number of screens (typically 50 to 75) are stacked on top of the screen support platform 15, an open-ended tubular side wall 20 of corrugated cardboard is placed over the stack of screens, with its lower end telescoped over the support platform and resting on top of the pallet. A cover 21 is then placed on the open upper end of the side wall, and the entire package may be strapped with one or more straps 22. A typical conventional package constructed in this manner has a height of about thirty inches and weighs approximately 750 pounds.

Figure 3:
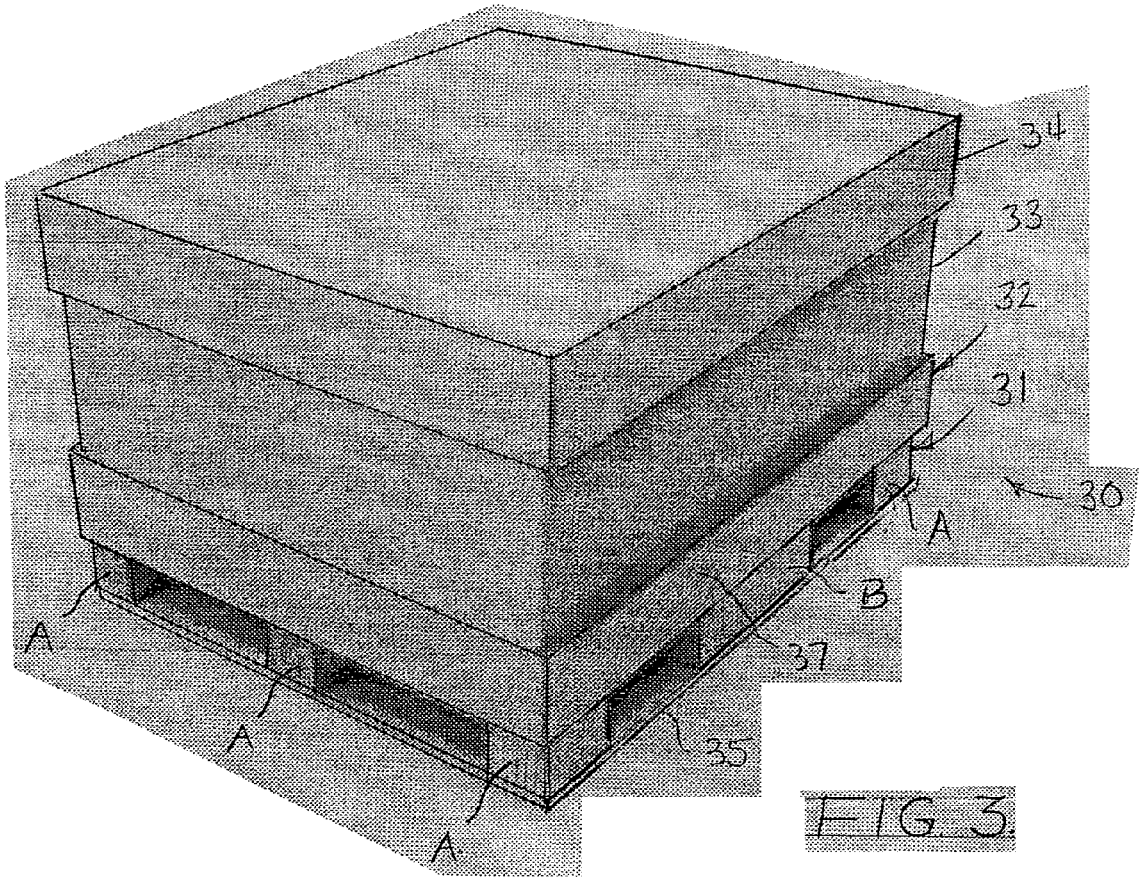
FIG. 3 is a top perspective view of a package according to the invention for shipping screens for large screen television sets.
Figure 4:
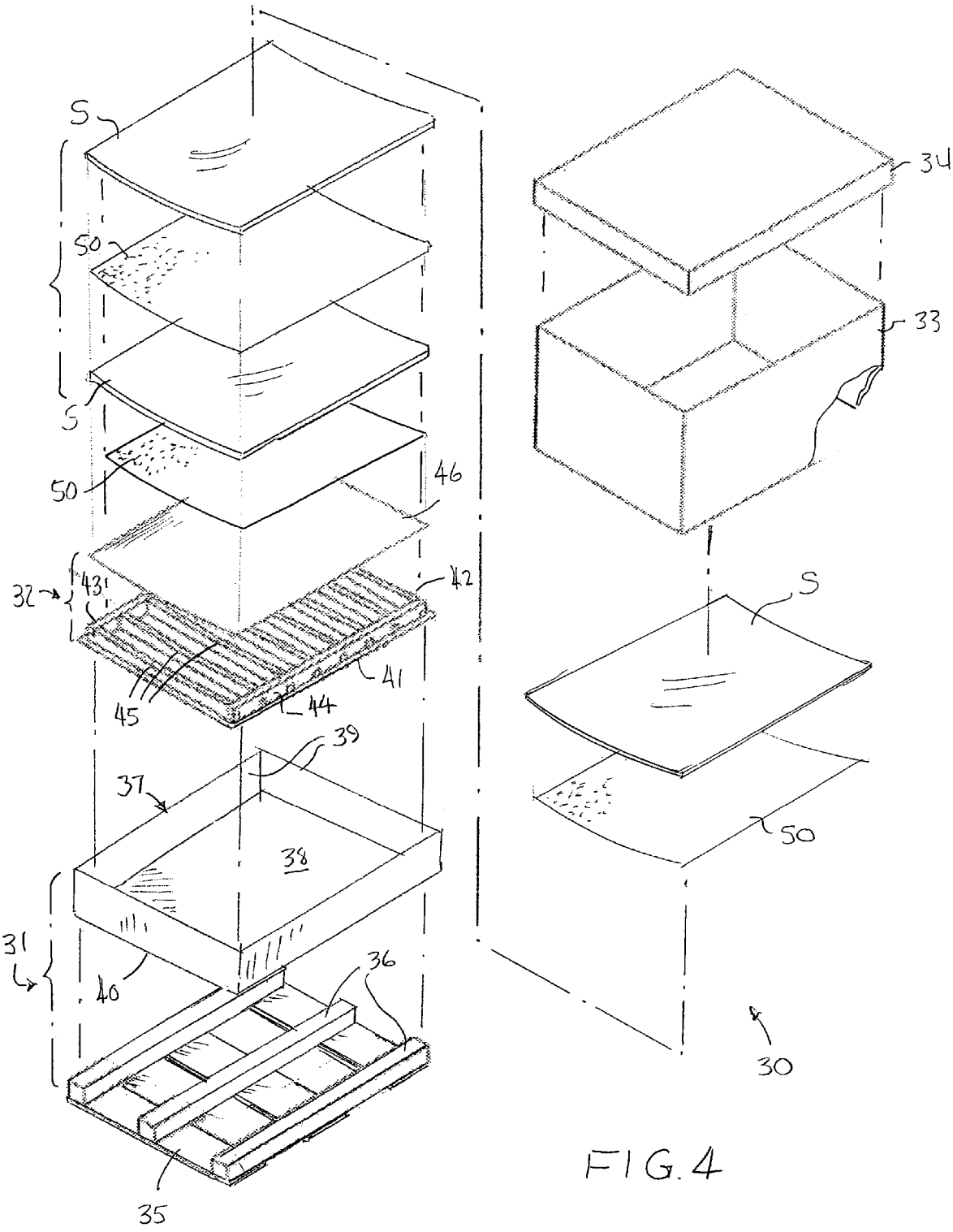
FIG. 4 is an exploded top perspective view of the package of FIG. 3, including a plurality of screens and foam inserts.

A package in accordance with the invention for shipping screens for large screen television sets is indicated generally at 30 in FIGS. 3 and 4. As in the conventional prior art container, the container of the invention comprises a pallet 31, a screen support platform 32 (seen best in FIG. 4), an open-ended tubular side wall 33, and a cover 34. In contrast to the prior art container, all of the components in the container of the invention are made of corrugated cardboard, significantly reducing the weight of the package. Moreover, all the components of the container of the invention are fully recyclable.

Figure 5:
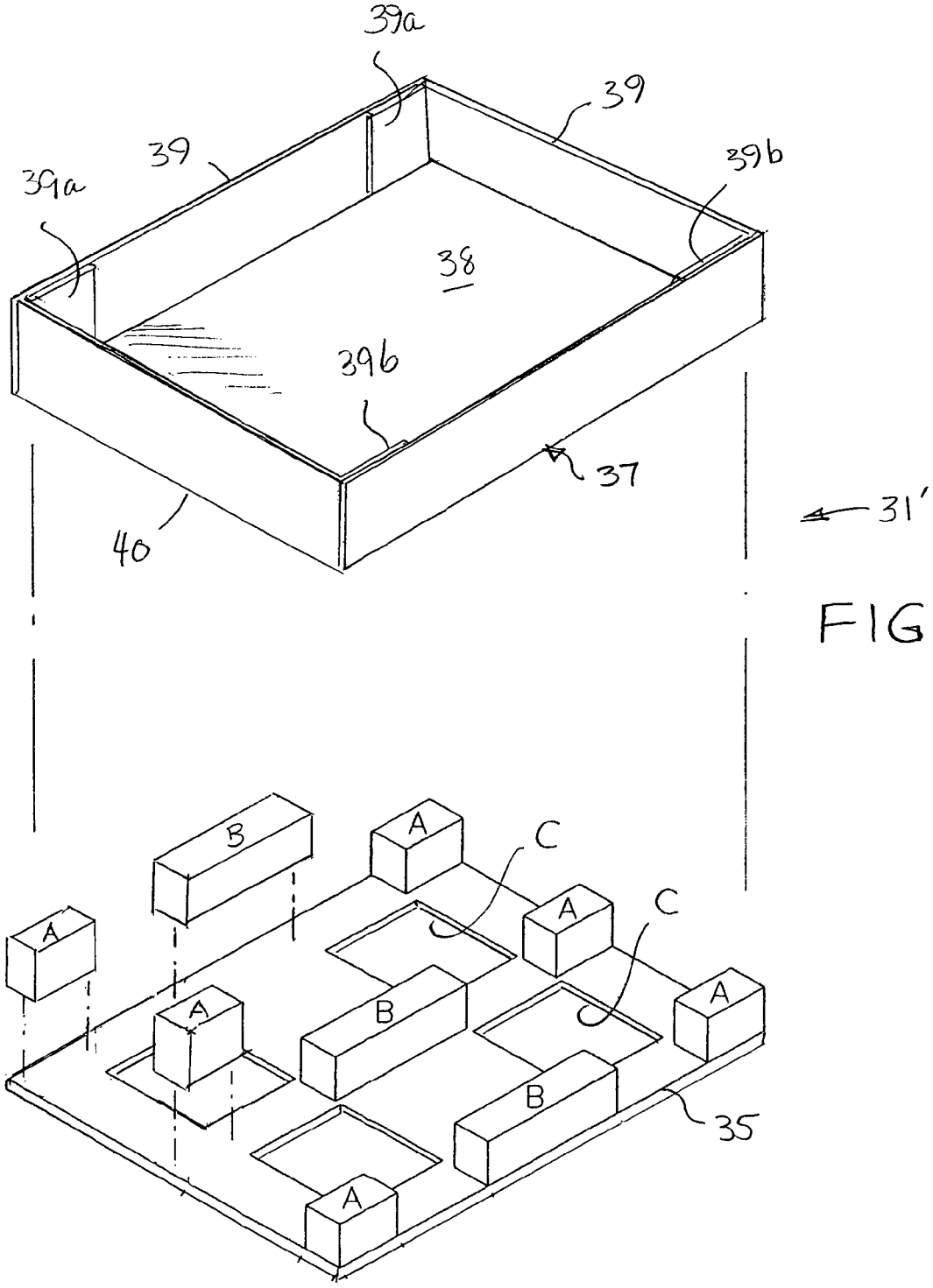
FIG. 5 is an exploded top perspective view of a first form of pallet and tray for use in the invention, intended for four-way access by the tines of a forklift.
Figure 11:
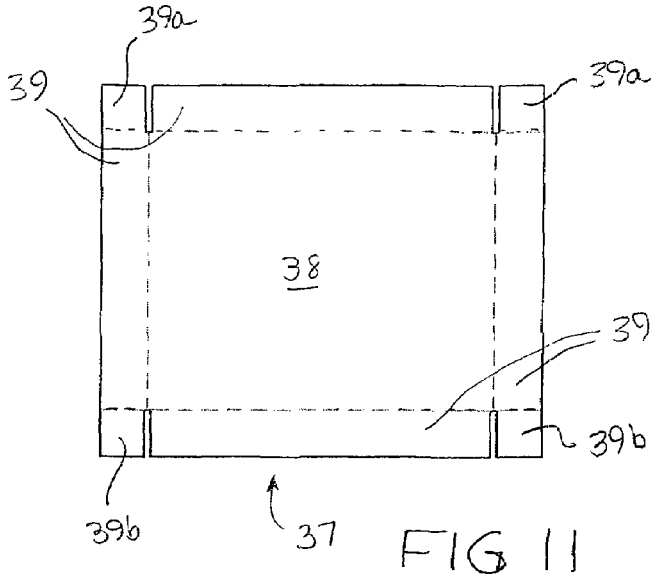
FIG. 11 is a top plan view of a blank for making the tray of FIG. 5.

In the container 30 of the invention, the pallet 31 comprises a bottom deck 35 and, in the embodiment shown in FIG. 4, a plurality of spaced apart pallet blocks or runners 36 fixed to the bottom deck and projecting upwardly therefrom. The use of runners 36 as shown in FIG. 4 affords only two-way access by the tines of a forklift. Four-way access is gained by using spaced blocks A and B as shown in FIGS. 3, 5, 8 and 9 on pallet 31'. Openings C may be provided through the bottom deck for accommodating the wheels of a pallet jack. A tray 37 having a bottom wall 38 and upstanding side walls 39 is mounted to the top of the pallet runners 36 and forms the top deck 40 of the pallet. As seen in FIGS. 5 and 11, glue flaps 39*a* and 39*b* on opposite ends of opposed side walls 39 are folded inwardly and glued to the inside of adjacent side walls to hold the tray in erected position.

Figure 6:
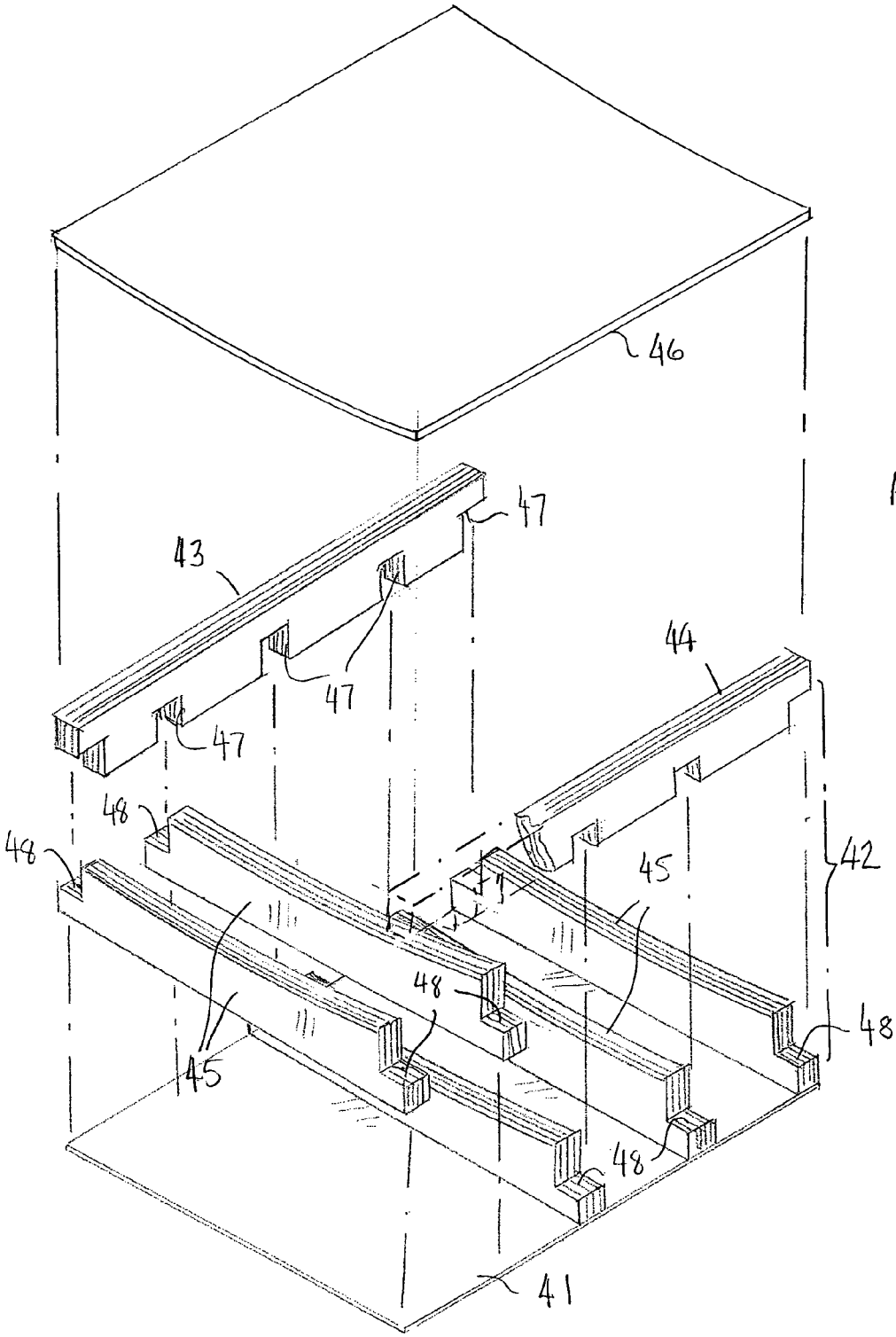
FIG. 6 is an exploded top perspective view of a screen support base for use in the container of the invention, with portions broken away for purposes of illustration.
Figure 7:
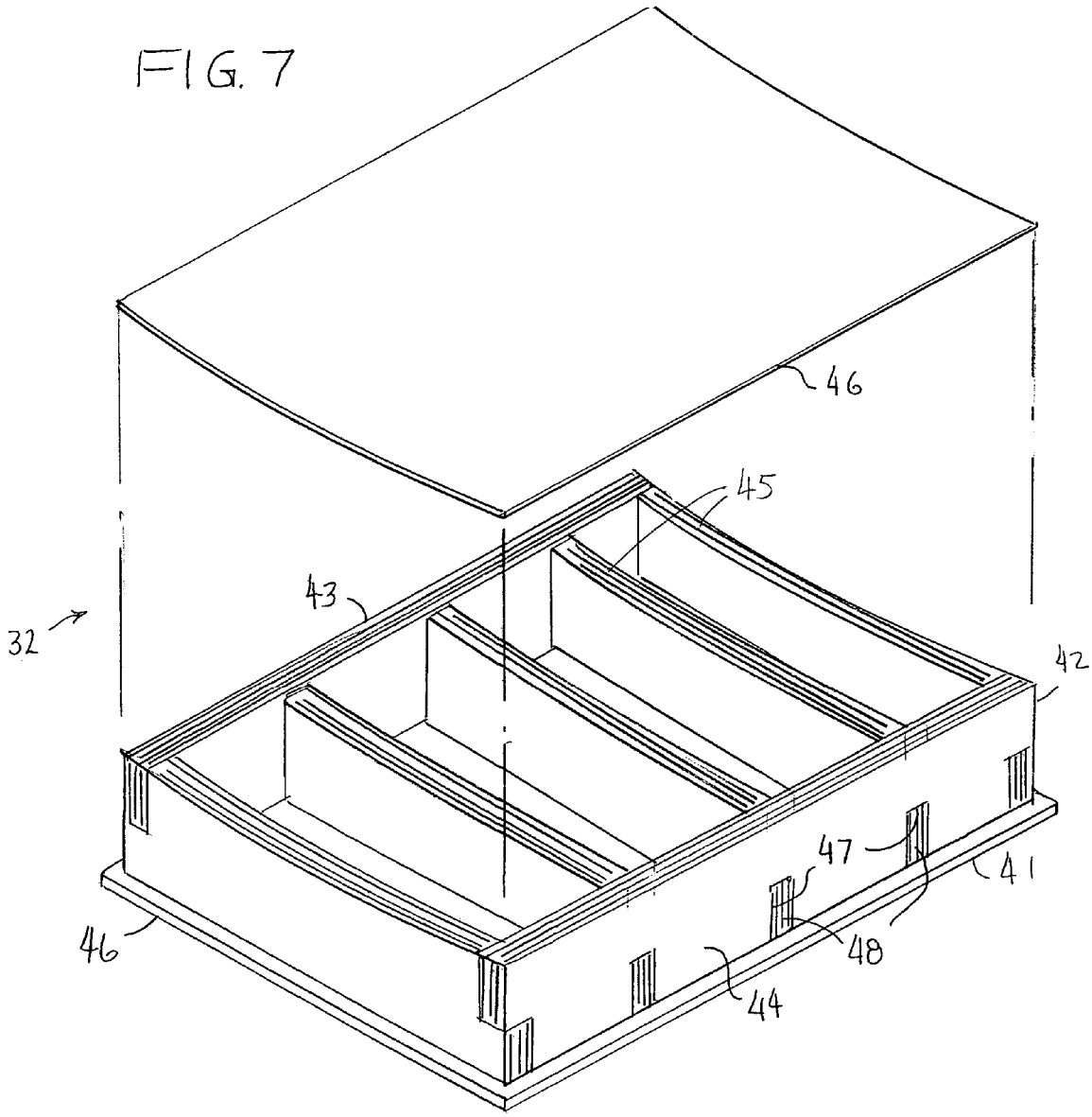
FIG. 7 is an exploded top perspective view of a partially assembled screen support base.

The screen support platform 32 comprises a base pad 41 and a frame 42 secured on top of the pad. The frame includes side pieces 43 and 44 and a plurality of uniformly spaced cross beams 45 extending transversely between the side pieces. A thin sheet 46 of paperboard or cardboard is affixed to the top of the frame to define a smooth, continuous support surface for the screens. The top surface of the cross beams, and the sheet 46 secured thereto, are curved to conform to the curvature of screens to be supported on the support platform. As seen best in FIGS. 6 and 7, the bottom edges of the side pieces are notched at 47 for mating engagement with notched ends 48 on the cross beams. The resulting structure is strong and durable when these notched elements are glued together and to the base pad.

Figure 8:
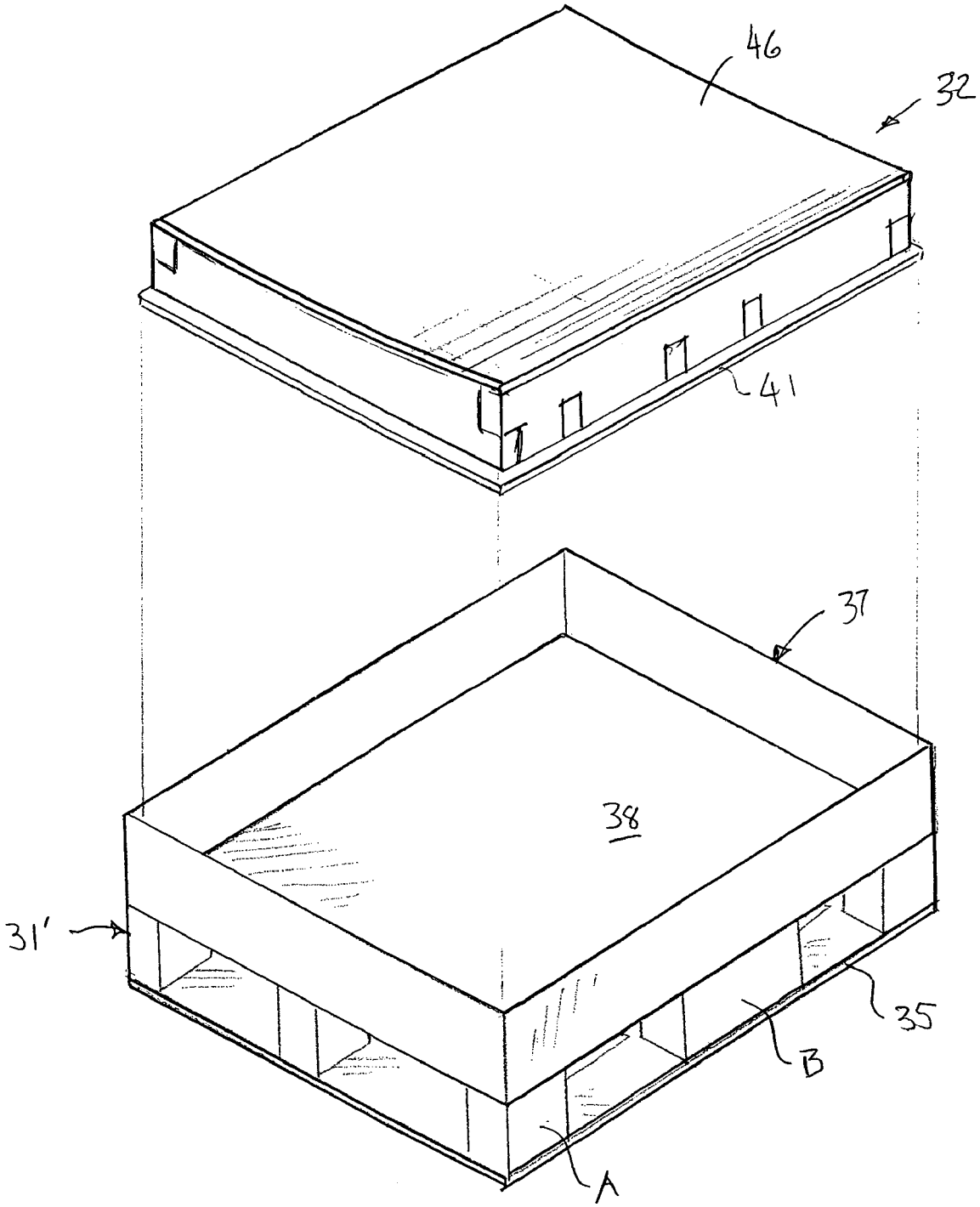
FIG. 8 is an exploded top perspective view of an assembled pallet-tray and an assembled screen support base.

The pallet 31' for four-way access is seen best in FIGS. 5 and 8, and comprises bottom deck 35 with a plurality of pallet blocks A and B secured to the top surface, and the tray 37 secured on top of the blocks to form a top deck 40 for the pallet.

Figure 9:
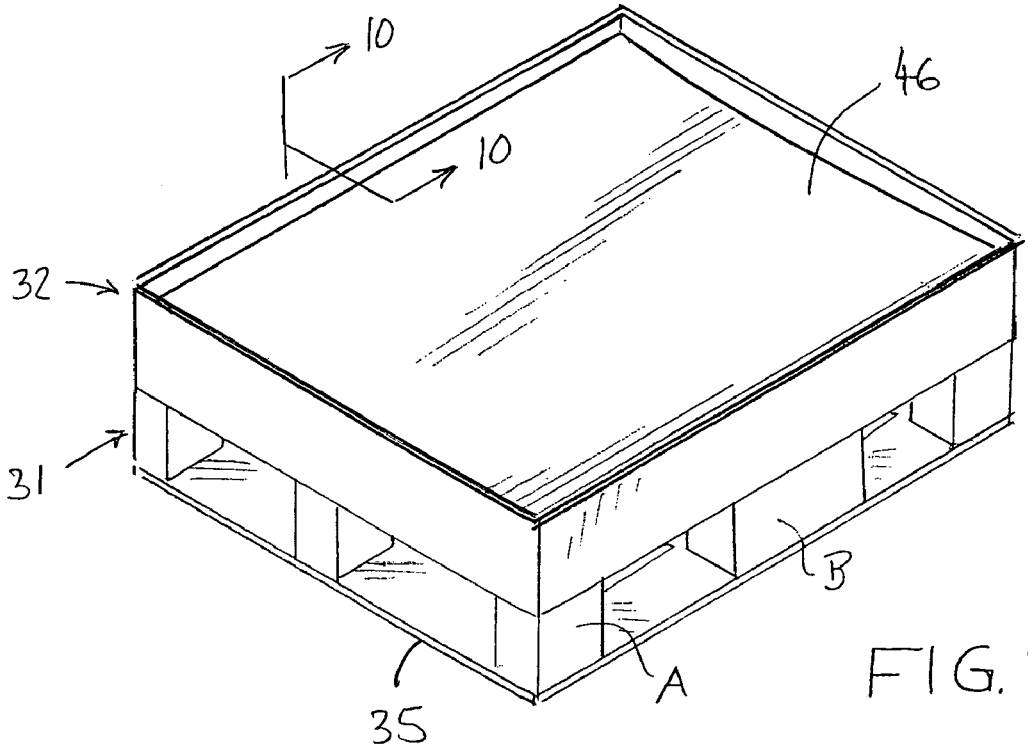
FIG. 9 is an assembled top perspective view of the pallet-tray and screen support base of FIG. 8.
Figure 10:
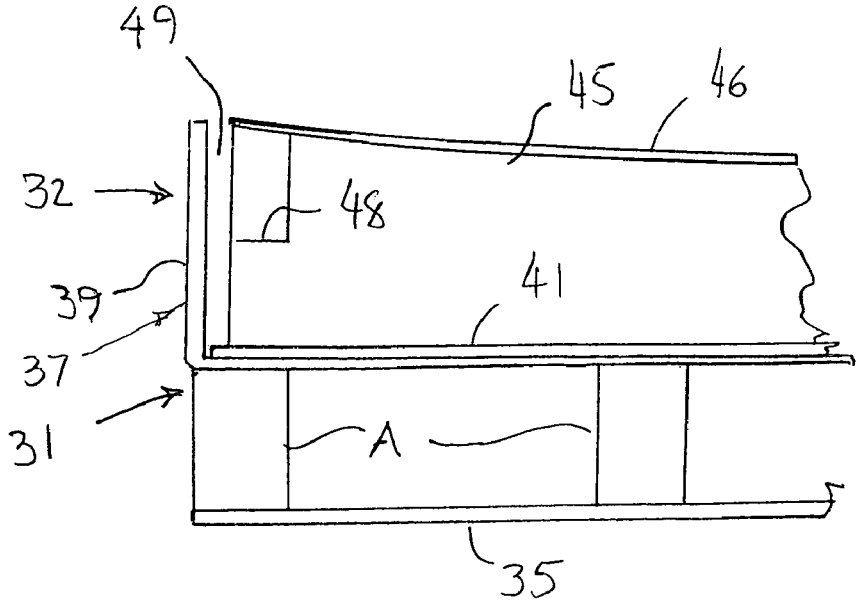
FIG. 10 is an enlarged fragmentary sectional view taken along lines 10—10 in FIG. 9, illustrating the gap or space into which the lower end of the side wall fits in a fully assembled package.

Referring to FIGS. 8, 9 and 10, the assembled screen support platform 32 is mounted inside the tray 37, leaving an annular space 49 between the walls 39 of the tray and the outer periphery of the support platform 32.

In use, a thin sheet or insert 50 of foam or other soft non-abrasive material is placed on the curved sheet 46 of the support platform, followed by a screen S, and subsequent alternating layers of foam and screens until the desired number are stacked on the support platform. The side wall 33 is then placed over the stack of screens, with its open bottom end extending into the annular space 49 and resting on the wall 38 of the tray, which forms the upper deck of the pallet 31 or 31'. Cover 34 is then placed on the open top end of the side wall to complete the package. If desired, a strap or straps (not shown) can be placed around the package to hold it assembled during handling.

Figure 12:
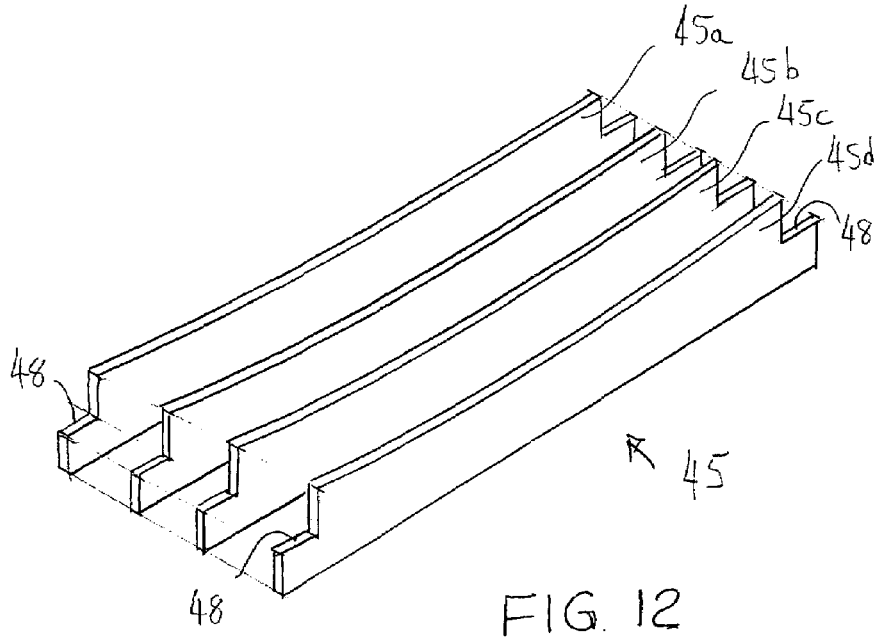
FIG. 12 is an exploded top perspective view of a plurality of die-cut panels that are laminated together to form one of the support elements in the screen support base of FIG. 6.

The cross beams 45 can be constructed is depicted in FIG. 12, wherein a plurality of die-cut pieces 45*a*, 45*b*, 45*c* and 45*d* are laminated and glued together.

Figure 13:
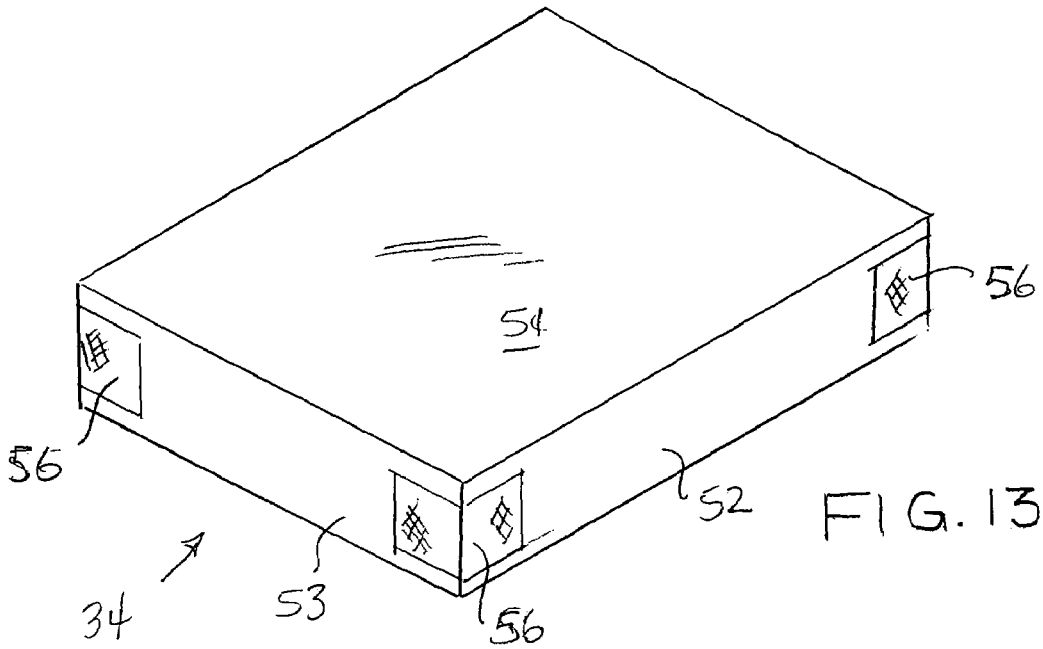
FIG. 13 is a top perspective view of an alternate cover for use with the container of the invention.
Figure 14:
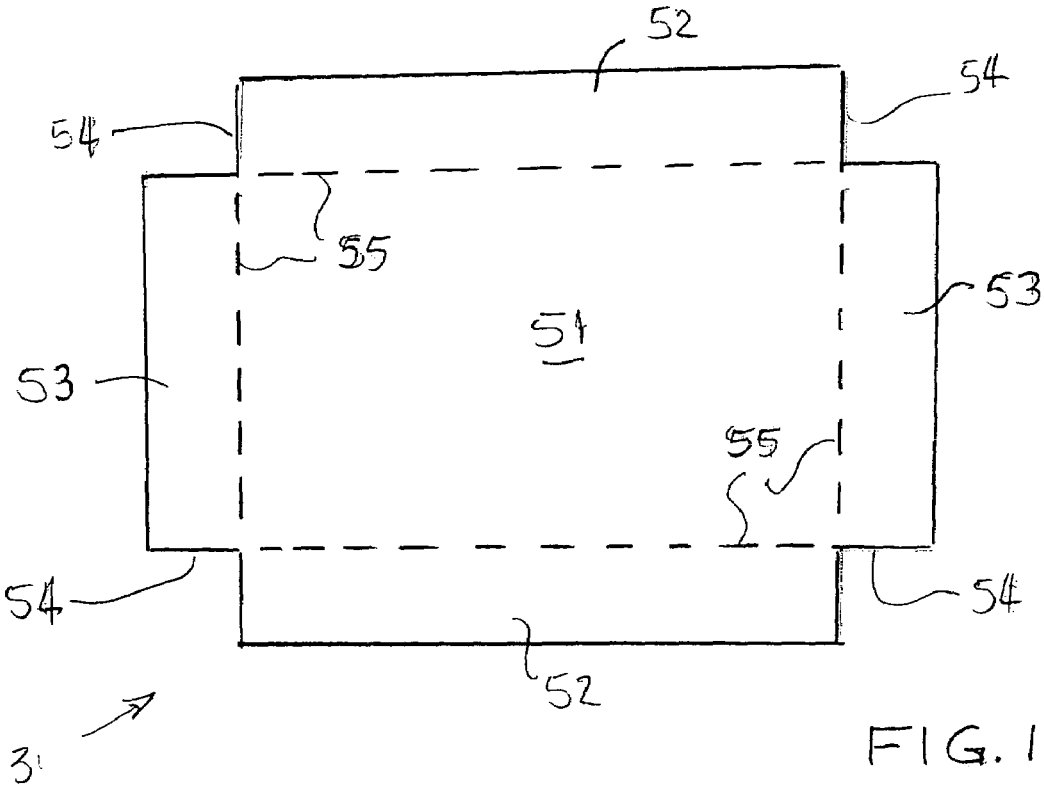
FIG. 14 is a top plan view of the alternate cover of FIG. 13.

The cover 34 can be constructed similarly to the tray, or alternatively, as shown in FIGS. 13 and 14, wherein the cover is shown as comprising a top wall 51 and depending side and end walls 52 and 53. The cover is formed from a single rectangular blank, with the corners cut away at 54, and fold lines 55 extending between the base of he cutes to form the panels that define the side and end walls 52 and 53 in the erected cover. The cover is held in erected position by strips of tape 56 placed around the corners.

The pallet 31, support platform 32, side wall 33 and cover 34 are all formed of corrugated cardboard, and the parts are glued, stapled, or otherwise suitably fastened together. The side wall 33 preferably is of triple wall construction.

The container constructed in accordance with the invention described herein has significantly less weight than prior art containers, and is fully recyclable.

Although particular embodiments of the invention are illustrated and described in detail herein, it is to be understood that various changes and modifications may be made to the invention without departing from the spirit and intent of the invention as defined by the scope of the appended claims.

What is claimed is:

1. A container for shipping screens for large screen television sets, comprising:

a screen support platform having a surface for supporting a plurality of the screens stacked thereon;

a pallet integrated with said screen support platform;

a tubular side wall having an open top end and an open bottom end, said bottom end adapted to rest on said pallet with said side wall disposed around a stack of screens when supported on said support platform; and a cover for placement over the open top end of the tubular side wall, wherein said screen support platform, said pallet, said side wall, and said cover all being constructed of corrugated cardboard;

said pallet includes a bottom deck, a top deck, and pallet blocks between the bottom deck and top deck, said pallet blocks defining openings between the top and bottom decks into which the tines of a forklift can be inserted;

said top deck comprising a tray having a bottom that is secured on top of the pallet blocks, and upstanding side walls around a peripheral margin of the pallet;

said screen support platform is received in said tray;

said screen support platform comprises a base pad that rests on said tray bottom, and a frame resting on and secured to a top surface of said base pad, said frame comprising a pair of spaced side frame members and a plurality of uniformly spaced cross beams extending between the side frame members;

a thin top sheet is secured on top of said frame, defining a smooth, continuous support surface for screens placed on said support platform; and the screens are curved, and said frame cross beams have a top surface that is curved complementary to the curvature of the screens, and the top sheet secured on top of said frame is also curved to conform to the curvature of the screens and to the frame top surface.

2. A container as claimed in claim 1, wherein:

said screen support platform has a slightly smaller horizontal dimension than the distance between the side walls of the tray, whereby an annular space is defined between the tray side walls and an outer periphery of the support platform to accommodate the bottom end of the tubular side wall.

3. A container as claimed in claim 1, wherein:

said side frame members have a plurality of spaced apart notches in a bottom edge thereof; and said cross beams each have opposite notched ends engaged in the notches in the bottom edge of the side frame members.

4. A container as claimed in claim 3, wherein:

said side frame members and said cross beams each comprises a plurality of individual die-cut panels laminated and glued together.

5. A container as claimed in claim 1, wherein:

said tubular side wall is of triple wall construction.

6. The container according to claim 1, wherein each of said frame cross beams has a top surface that is concave.

7. The container according to claim 1, wherein each of said frame cross beams has a top surface and a bottom surface, the distance between a middle portion of said top surface and said bottom surface is less than the distance between an edge portion of said top surface and said bottom surface.

8. A container for shipping at least one object having a curved configuration, comprising:

a platform having a surface for supporting the at least one object and comprising a frame and a top sheet, a pallet integrated with said platform, and a side wall having an open bottom end, said bottom end adapted to rest on said pallet with said side wall disposed around the at least one object when supported on said platform, wherein said frame comprises a pair of spaced side frame members and at least one cross beam extending between the side frame members;

said at least one frame cross beam has a top surface that is curved complementary to the curvature of the at least one object;

said top sheet defines a support surface for the at least one object placed on said platform;

said top sheet is also curved to conform to the curvature of the at least one object and to the curvature of the frame top surface; and said platform, said pallet, and said side wall all being constructed of corrugated cardboard.

9. The container according to claim 8, wherein said at least one frame cross beam has a top surface that is concave.

10. The container according to claim 8, wherein said at least one frame cross beams has a top surface and a bottom surface, the distance between a middle portion of said top surface and said bottom surface is less than the distance between an edge portion of said top surface and said bottom surface.

11. The container according to claim 8, wherein the side wall is tubular.

12. The container according to claim 8, wherein said pallet comprises a bottom deck, a top deck, and pallet blocks between the bottom deck and top deck, said pallet blocks defining openings between the top and bottom decks into which the tines of a forklift can be inserted.

13. The container according to claim 12, wherein said top deck comprises a tray having a bottom that is secured on top of the pallet blocks, and upstanding side walls around a peripheral margin of the pallet.

14. The container according to claim 13, wherein said platform is received in said tray.

15. The container according to claim 14, wherein said platform comprises a base pad that rests on said tray bottom.

16. The container according to claim 15, wherein said frame rests on and is secured to a top surface of said base pad.

17. The container according to claim 8, wherein said frame comprises a plurality of cross beams extending between the side frame members.

18. The container according to claim 8, wherein said frame comprises a plurality of uniformly spaced cross beams extending between the side frame members.

19. The container according to claim 8, wherein said top sheet is a thin top sheet.

20. The container according to claim 8, wherein said top sheet is secured on top of said frame.

21. The container according to claim 8, wherein said top sheet is secured on top of said frame, defining a smooth, continuous support surface for the at least one object placed on said platform.

22. The container according to claim 8, further comprising a tray positioned between said platform and said pallet.

23. The container according to claim 8, further comprising a tray, wherein said platform is received in said tray.

24. The container according to claim 8, wherein the platform further comprises a base pad.

25. The container according to claim 8, further comprising a tray, wherein said platform is received in said tray; and the platform further comprises a base pad that rests on said tray bottom.

26. The container according to claim 25, wherein said platform has a slightly smaller horizontal dimension than the distance between the side walls of the tray, whereby an annular space is defined between the tray side walls and an outer periphery of the platform to accommodate the bottom end of the side wall.

27. The container according to claim 8, wherein said side frame members have a plurality of spaced apart notches in a bottom edge thereof, and said at least one frame cross beam has opposite notched ends engaged in the notches in the bottom edge of said side frame members.

28. The container according to claim 8, wherein said side frame members and said at least one frame cross beam comprise a plurality of individual die-cut panels laminated and glued together.

29. The container according to claim 8, wherein the side wall has an open top end.

30. The container according to claim 29, further comprising a cover for placement over said side wall and being constructed of corrugated cardboard.

31. The container according to claim 8, further comprising a cover for placement over said side wall and being constructed of corrugated cardboard.

32. The container according to claim 8, further comprising a cover for placement over said sidewall and being constructed of corrugated cardboard, wherein said cover comprises at least one glue flap.

33. The container according to claim 8, further comprising a cover for placement over said sidewall and being constructed of corrugated cardboard, wherein said cover comprises tape placed around at least one corner.

34. The container according to claim 8, further comprising a tray, wherein a bottom end of said side wall is received in said tray.

35. The container according to claim 8, wherein at least one of said frame members includes a notch for mating engagement with a notched end of at least one cross beam.

36. The container according to claim 8, wherein:

said side wall is of triple wall construction.

* * * * *